US007974818B2

(12) United States Patent
Sakurai et al.

(10) Patent No.: US 7,974,818 B2
(45) Date of Patent: Jul. 5, 2011

(54) SOLIDIFICATION ANALYSIS METHOD AND APPARATUS

(75) Inventors: Kazunari Sakurai, Oyama (JP); Hiroshi Onda, Hiratsuka (JP)

(73) Assignee: Nissan Motor Co., Ltd., Yokohama-shi, Kanagawa (JP)

( * ) Notice: Subject to any disclaimer, the term of this patent is extended or adjusted under 35 U.S.C. 154(b) by 699 days.

(21) Appl. No.: 11/972,813

(22) Filed: Jan. 11, 2008

(65) Prior Publication Data

US 2008/0169074 A1 Jul. 17, 2008

(30) Foreign Application Priority Data

Jan. 12, 2007 (JP) ..... 2007-004868
Sep. 20, 2007 (JP) ..... 2007-244308

(51) Int. Cl.
*G06F 7/60* (2006.01)
*G06F 17/10* (2006.01)

(52) U.S. Cl. ..... 703/2

(58) Field of Classification Search ..... 703/2
See application file for complete search history.

(56) References Cited

U.S. PATENT DOCUMENTS 5,097,431 A * 3/1992 Harada et al. ..... 703/9
5,681,407 A * 10/1997 Yu et al. ..... 148/633
5,841,669 A * 11/1998 Purvis et al. ..... 702/179
6,019,930 A * 2/2000 Baresich ..... 264/327
6,816,820 B1 * 11/2004 Friedl et al. ..... 703/2
7,024,342 B1 * 4/2006 Waite et al. ..... 703/6
7,473,028 B1 * 1/2009 Alexandrov et al. ..... 374/10
2002/0150498 A1 * 10/2002 Chakrabarti et al. ..... 420/532
2003/0135977 A1 * 7/2003 Riviere et al. ..... 29/527.7
2005/0150579 A1 * 7/2005 Chakrabarti et al. ..... 148/439
2006/0083654 A1 * 4/2006 Chakrabarti et al. ..... 420/532
2006/0282186 A1 * 12/2006 Hansen et al. ..... 700/97

FOREIGN PATENT DOCUMENTS

JP 2004-038444 A 2/2004

OTHER PUBLICATIONS

Ya Meng, Brian G. Thomas, "Heat-Transfer and Solidification Model of Continuous Slab Casting:CON1D" Metallurgical and Materials Transactions B, vol. 34B, Oct. 2003, pp. 685-705.*
M.M. Pariona, A.C. Mossi, "Numerical Simulation of Heat Transfer During the Solidification of Pure Iron in Sand and Mullite Molds" J. of the Braz. Soc. of Mech. Sci & Eng. Oct.-Dec. 2005, Vol. XXVII, No. 4, pp. 399-406.*

(Continued)

*Primary Examiner* — Dwin M Craig
(74) *Attorney, Agent, or Firm* — Young Basile

(57) ABSTRACT

A solidification analysis method of a cast that can predict a molten temperature drop history with fine precision is disclosed. The analysis is performed by considering different latent heat emitting patterns according to the differences of the cooling speeds. An analysis model having a plurality of elements is used. A cooling speed is calculated in each element by performing a calculation of heat transfer between the elements adjacent to each other. A temperature fluctuation range is revised in each element when a temperature fluctuates from emission of solidification latent heat based on the calculated cooling speed and a predetermined fraction solid-temperature curve of a molten alloy. A solidification analysis of the analysis model is performed by using the revised temperature fluctuation range.

10 Claims, 7 Drawing Sheets

OTHER PUBLICATIONS

T. Koseki, T. Matsumiya, W. Yamada, T. Ogawa, "Numerical Modeling of Solidification and Subsequent Transformation of Fe—Cr—Ni Alloys" Metallurgical and Materials Transactions A, vol. 25A, Jun. 1994, pp. 1309-1321.*

K N Seetharamu, R Paragasam, Ghulam A Quadir, Z A Zainal, B Sathya Prasad, T Sundararajan, "Finite element modelling of solidification phenomena", Sadhana, vol. 26, Parts 1 & 2, Feb.-Apr. 2001, pp. 103-120.*

Adrian S. Sabau, "Alloy Shrinkage Factors for the Investment Casting Process" Metallurgical and Material Transactions B, vol. 37B, Feb. 2006, pp. 131-140.*

Kenichi Ohsasa, Mayumi Shoji and Toshio Narita, "Prediction of Solidification Behavior in AC8C Alloy by Thermodynamic Calculation," Casting Engineering, No. 8., vol. 72, pp. 525-529 (Aug. 25, 2000).

* cited by examiner

SOLIDIFICATION ANALYSIS METHOD AND APPARATUS

CROSS-REFERENCE TO RELATED APPLICATIONS

This application claims priority from Japanese Patent Application Serial Nos. 2007-004868, filed Jan. 12, 2007, and 2007-244308, filed Sep. 20, 2007, each of which is incorporated herein in its entirety by reference.

TECHNICAL FIELD

The invention generally relates to a solidification analysis method of a cast, and more particularly to a solidification analysis method and apparatus that use a simulation by an electronic calculator.

BACKGROUND

In order to manufacture an optimal and inexpensive cast, it is necessary to assess the configuration of the cast required before manufacture. To achieve this, a casting analysis using an electronic calculator, or computer, has been broadly used.

The casting analysis may be based on various parameters, such as flow, deformation, solidification, and the like. In particular, solidification is an important parameter and analysis of such can be used predicting a contraction generating region or the size thereof.

In the solidification analysis, a fraction solid is calculated based on emitted latent heat that is lost at a temperature equal to or less than a liquid line. The fraction solid is increased due to the latent heat emission. When calculating the fraction solid using such a method, a curve of the fraction solid verses temperature is used for calculating the latent heat, which is a key element of a solidification process. See Kenichi Ohsasa, Mayumi Shoji and Toshio Narita, "Prediction of Solidification Behavior in AC8C Alloy by Thermodynamic Calculation," Casting Engineering, No. 8., Vol. 72, pp. 525-529 (Aug. 25, 2000).

BRIEF SUMMARY

Embodiments of the invention provide a solidification analysis method of a cast and a solidification analysis apparatus thereof wherein the analysis can be performed by considering different latent heat emitting patterns depending on the differences in the cooling speed so that the molten temperature drop history can be predicted with a high precision.

One example of a solidification analysis method of a cast using a mold having a plurality of elements taught herein comprises establishing initial data of the mold, wherein the initial data includes at least a start temperature, measuring a heat transfer from each element of the mold based on latent heat emission, predicting a designated temperature for each element based on the heat transfer measured, calculating a cooling speed based on a change from the start temperature to the designated temperature over a predetermined time interval, providing a fraction solid-temperature curve based on the cooling speed and a molten alloy of the mold, calculating a change in a fraction solid, calculating a corrected designated temperature based on the fraction solid-temperature curve and the change in fraction solid and repeating the method with the corrected temperature as the start temperature.

Also disclosed are various embodiments of an apparatus for solidification analysis of a cast using a mold having a plurality of elements. One apparatus comprises calculating means for calculating a cooling speed in each element from a latent heat emitted from each element, means for correcting or revising a temperature fluctuation range in each element due to the emission of latent heat based on the calculated cooling speed and a predetermined fraction solid-temperature curve of a molten alloy and means for performing a solidification analysis of the analysis model by using the corrected or revised temperature fluctuation range.

BRIEF DESCRIPTION OF THE DRAWINGS

The description herein makes reference to the accompanying drawings wherein like reference numerals refer to like parts throughout the several views, and wherein.

DETAILED DESCRIPTION OF EMBODIMENTS OF THE INVENTION

In conventional casting analysis methods, the latent heat is calculated using a constant relationship between the fraction solid and the temperature, regardless of the difference in cooling speed. Because the analysis does not consider how a variance in cooling speed affects the latent heat emitting pattern, a highly precise molten temperature drop history cannot be predicted. In contrast, exemplary embodiments of the invention are described below in detail with reference to the drawings in which different latent heat emitting patterns are considered depending on the differences in the cooling speed. Accordingly, the molten temperature drop history can be predicted with a high precision.

Figure 1:
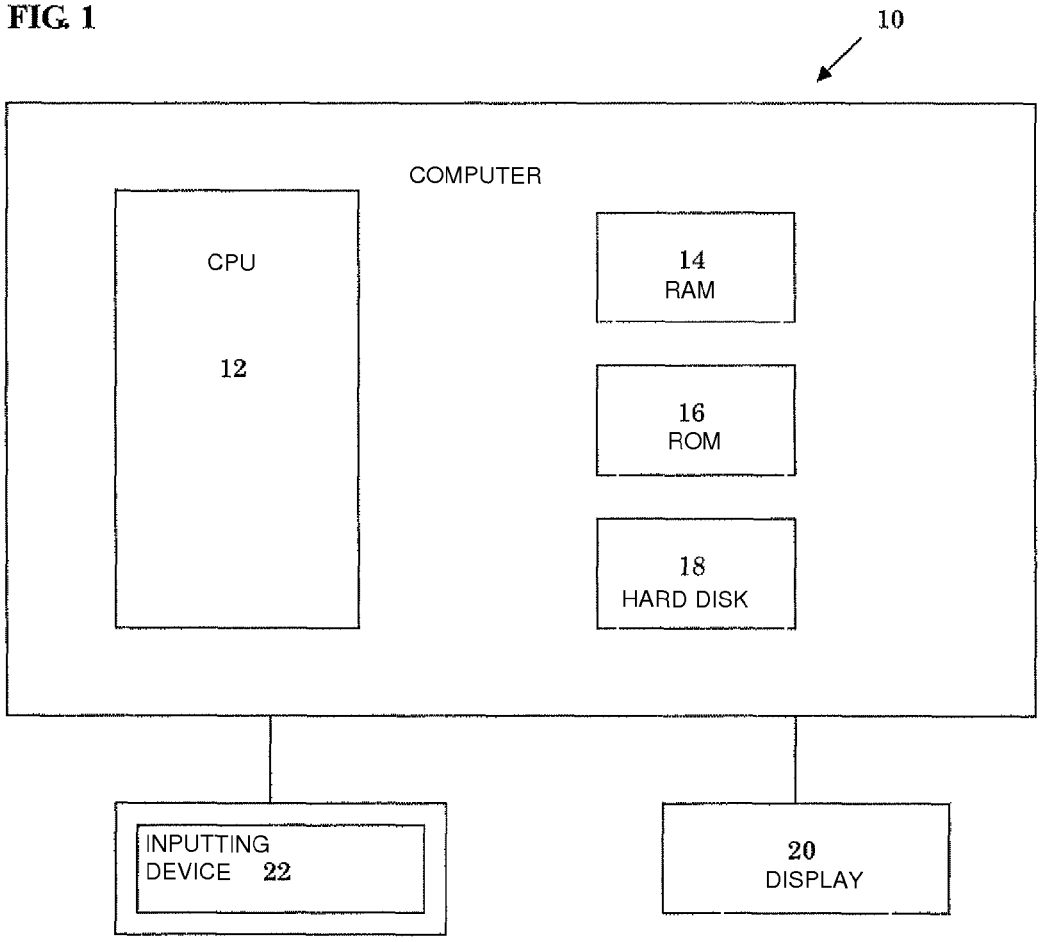
FIG. 1 is a computer configured to perform various embodiments of the methods taught herein.

The processes explained below are performed by a computer incorporating a program to perform a simulation of the solidification analysis as discussed in more detail hereinafter. The computer 10 shown by example in FIG. 1 is a personal computer conventionally comprising a central processing unit (CPU) 12, a random access memory (RAM) 14, a read-only memory (ROM) 16, a hard disk 18, a display 20 and an inputting device 22, each of which is connected to each other via a bus (not shown) for transmitting and receiving a signal.

Of course, the computer can be a more simplified device such as a microcontroller or the like receiving the inputs and performing the functions described herein. More specifically, the computer performs a heat transfer solidification analysis based on a simulation program of the solidification analysis. The computer may process and display various information obtained from the analysis. Accordingly, the computer performs the functions of cooling speed calculation, revision and a solidification analysis as discussed next.

In the illustrated embodiment, the CPU 12 performs various types of operations necessary to control each part as mentioned above or the heat transfer solidification analysis based on the simulation program. The RAM 14 is a working area for temporarily storing a program or data. The ROM 16 has stored various types of programs or parameters for controlling a basic operation of the computer 10.

The hard disk 18 stores a program or data for controlling a desired operation of an operating system of the computer. The hard disk has been previously programmed with the program instructions for the heat transfer/solidification analysis, which includes programs necessary for the preparation of the analysis model, various properties of the heat transfer/solidification analysis, processing and/or displaying the information obtained from the analysis results and other general heat transfer/solidification analysis. Also programmed is the fraction solid-temperature curve showing a relationship between the fraction solid of the alloy and the temperature. The hard disk 18 also serves as a storage area for storing the analysis results. Alternatively, the program instructions for the heat transfer/solidification analysis may be stored in a recording medium (e.g., CD-ROM, DVD-ROM, etc.) inserted into the computer 10. The heat transfer solidification analysis may be performed in the computer 10 by directly reading the program instructions from the recording medium.

The display 20 is, for example, a CRT display or liquid crystal display for displaying various types of information obtained from the analysis results. The inputting device 22 is a pointing device such as a mouse, a keyboard or a touch panel for receiving an input from a user.

The solidification analysis method in accordance with embodiments of the invention is carried out by using the computer 10 as mentioned above. The entire process of the solidification analysis method of a cast in accordance with an embodiment is explained with reference to FIG. 2.

Figure 2:
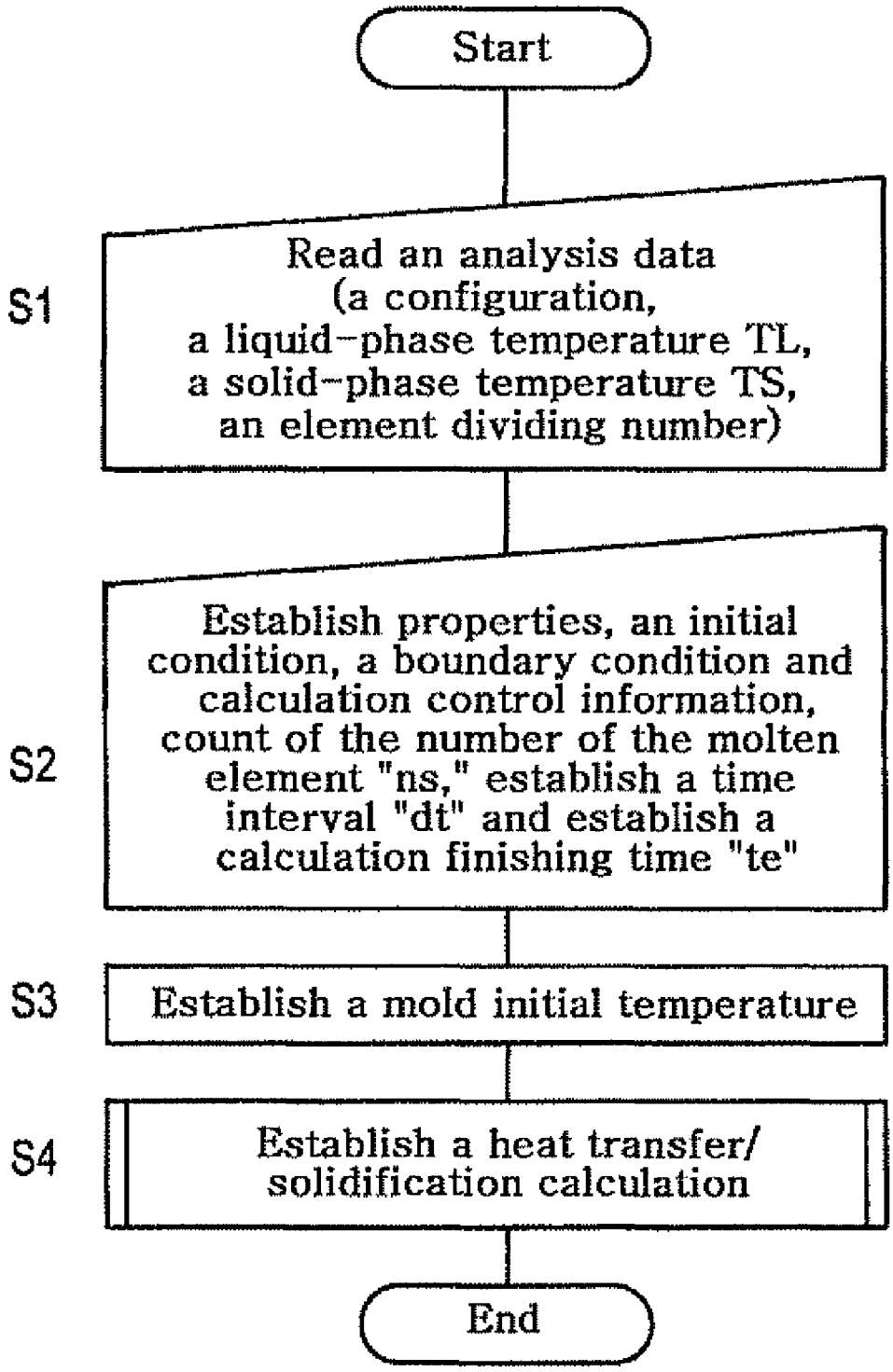
FIG. 2 is a flow chart showing a process of performing a solidification analysis method of a cast in accordance with one embodiment of the invention.

As shown in FIG. 2, analysis data previously stored in the computer is first read in step S1. Here, the analysis data includes, for example, configuration data, a liquid line temperature TL, a solid-phase line temperature TS and an element dividing number. The configuration data is used in the solidification analysis of the cast to determine a configuration of the cast, a design of the cast and a configuration of a mold.

The liquid line temperature TL and the solid-phase line temperature TS vary depending on the metal used for casting. Generally, the liquid line temperature TL is an equilibrium temperature of the molten body. That is, the liquid line temperature TL is a minimum temperature at which a crystal no longer exits. The solid-phase temperature TS is the minimum temperature at which the molten body no longer exists.

A solidification analysis method in accordance with the invention may perform an analysis with respect to alloys having different latent heat emitting patterns depending on the differences in the cooling speed of the molten metal. Such a metal may include mold casting alloys such as AC2A.

The element dividing number is used to prepare the analysis model when performing the simulation. The number is equal to the number of cells, also referred to as elements. More specifically, the element dividing number is equal to the number of cells or elements of a mesh model; element division is performed with regard to the mesh model used during simulation. In the solidification analysis of the present embodiment, methods may be used for a general solidification analysis such as a finite difference method (FDM) or finite element method (FEM).

In step S2 analysis conditions such as properties, the initial condition, the boundary condition and calculation control information are established. Calculation control information includes the information necessary to the analysis method, such as a count of the number of the molten elements ns, an establishment of the time interval dt and an establishment of calculation finishing time te. The properties, the initial condition and the boundary condition may vary depending on the metal to be cast.

In step S3 the mold initial temperature is established. Generally, the mold initial temperature is established at the casting process during analysis. However, during simulations or evaluations of the solidification analysis, the mold initial temperature may be varied.

The heat transfer/solidification calculation is performed in step S4 based on the initial mold temperature, and the process is finished or repeated. The heat transfer/solidification calculation of step S4 is explained in detail with reference to FIG. 3.

Figure 3:
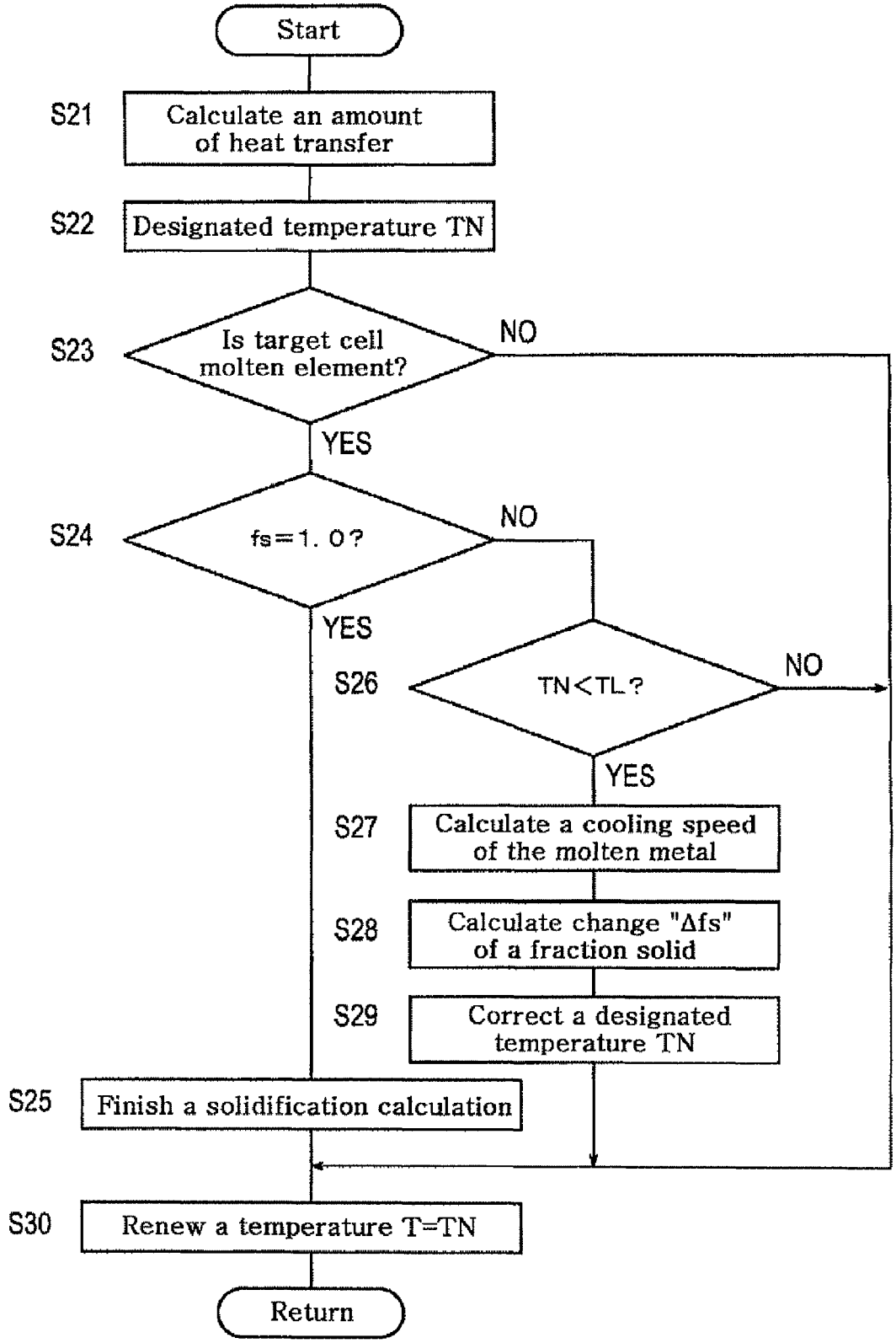
FIG. 3 is a diagram showing a process of a heat transfer and solidification calculation.

As shown in FIG. 3, a heat transfer calculation of step S21 determines the amount of heat emitted from a target cell of the general analysis model.

In step S22 a designated temperature TN at a desired time of a target cell is calculated from the amount of heat transfer from step S21. The designated temperature TN is the temperature predicted after the time interval dt.

In step S23 a determination is made as to whether the target cell is a molten element. If the target cell is not a molten element, the process proceeds to step S30. A non-molten element is one that has not spread out to the cell or is already solidified.

If the cell is a molten element in response to the query of step S23, a continuous determination of whether the fraction solid fs of the cell is 1.0 or not is initiated in step S24. In the present process, when the fraction solid fs is calculated to be equal to or greater than 1.0, the process is performed based on a fraction solid fs of 1.0. When the fraction solid fs is 1.0, the cell is solidified; thus, the solidification calculation is complete in step S25. If the fraction solid fs is less than 1.0 in response to the query of step S24, the designated temperature TN of the cell and the liquid line temperature TL are compared in step S26.

In step S26, when the designated temperature TN of the cell is equal to or greater than the liquid temperature TL, that entire cell is determined to be liquid. Because solidification has not yet begun, the process proceeds to step S30.

When the designated temperature TN of the cell is less than the liquid line temperature TL, solidification is in progress. At this point, the cooling speed of the molten metal is calculated in step S27, the fraction solid fs is recalculated in step S28, and the designated temperature TN is corrected in step S29 based on the calculated cooling speed and the recalculated fraction solid fs. At step S30 the recalculated designated temperature TN becomes the temperature T of each cell.

Figure 4:
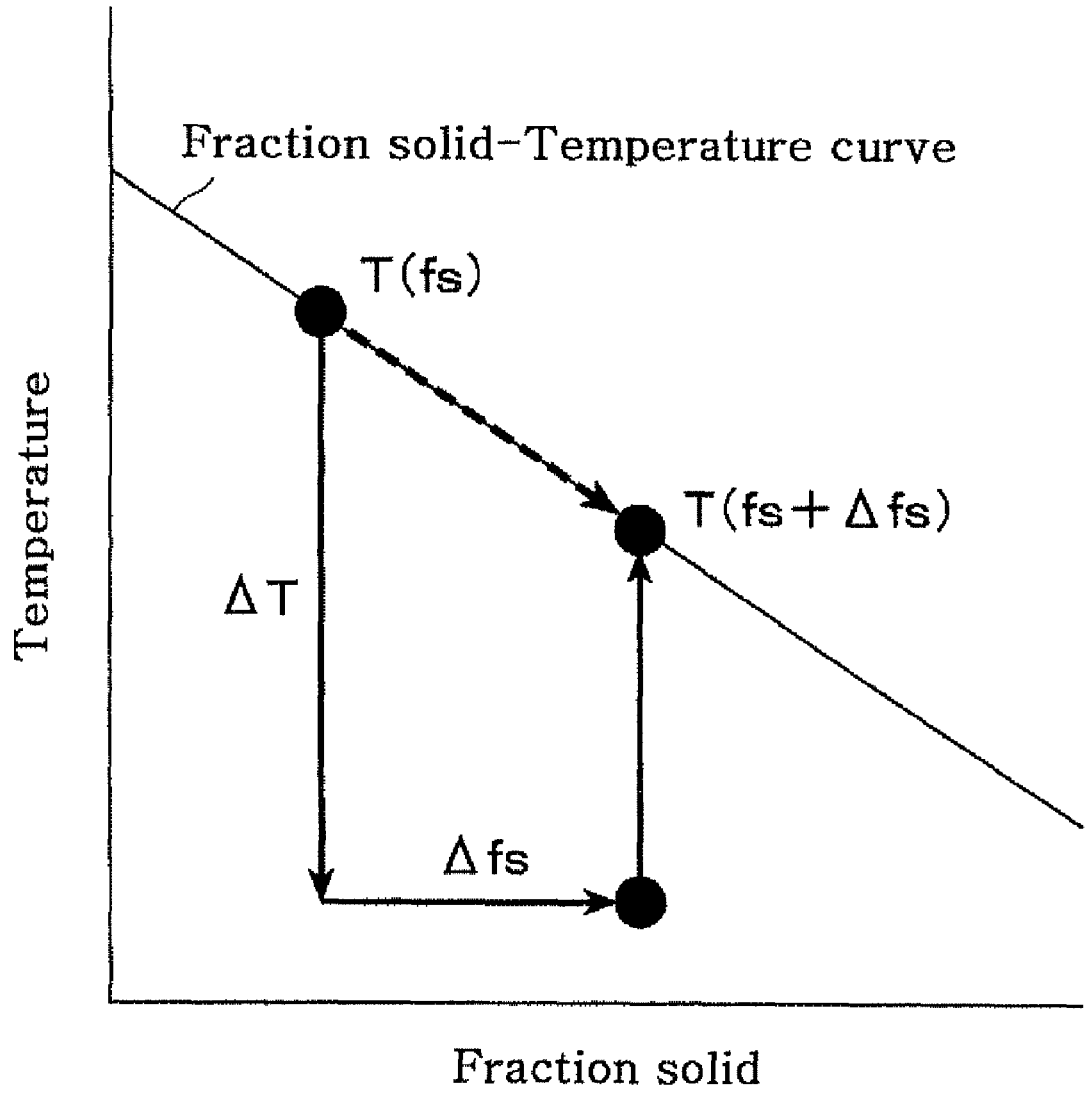
FIG. 4 is a schematic view of a fraction solid-temperature curve.

Steps S27 to S29 are explained in detail with reference to FIG. 4,

FIG. 4 schematically shows one example of a fraction solid-temperature curve. As described above, at a temperature equal to or lower than the liquid line, latent heat is emitted corresponding to the amount of heat lost when the liquid-phase is changed into a solid phase. The fraction solid is increased by such latent heat emission. In calculating the fraction solid during the solidification process at the calculated latent heat, the fraction solid-temperature curve is used.

In the solidification analysis method in accordance with this embodiment, the fraction solid-temperature curve in FIG. 4 depends upon the alloy type analyzed. Based on a temperature drop $\Delta T$ of the molten metal per desired time dt, the cooling speed v of the molten alloy being analyzed is calculated. The method of calculating the cooling speed v is not limited and can be calculated, for example, by a drop time per desired temperature range. The analysis is performed by revising the fraction solid-temperature curve in FIG. 4 through using the calculated cooling speed v and revising a temperature range in a direction wherein a temperature is recovered (called a temperature fluctuation range). Because the analysis is performed by considering the latent heat emitting pattern according to the cooling speed v, a precise temperature drop history and fraction solid change can be obtained.

The revision of the temperature is performed by first calculating the temperature drop ΔT. If the temperature drop ΔT>0, solidification occurs due to the temperature fluctuation caused by the emission of the latent heat. Referring back to step S27 of FIG. 3, the cooling speed v of the molten alloy is calculated based on the temperature drop ΔT of the molten metal per desired time dt. Then, in step S28 the fraction solid change Δfs is calculated using the formula:

$$\Delta fs = C_p \frac{\Delta T}{L}; \text{ wherein} \quad (1)$$

$C_p$ is specific heat; and $L$ is the latent heat.

In step S29 the designated temperature TN is corrected by revising the temperature fluctuation range when the temperature is fluctuated by the emission of the solidification latent heat. Specifically, the temperature fluctuation range is revised in each cell based on the amount of the fraction solid change Δfs and the cooling speed v occurring within a desired time. Because the analysis is performed by considering different latent heat emitting patterns according to the differences in the cooling speed v, a precise temperature drop history and fraction solid change can be obtained.

Figure 5:
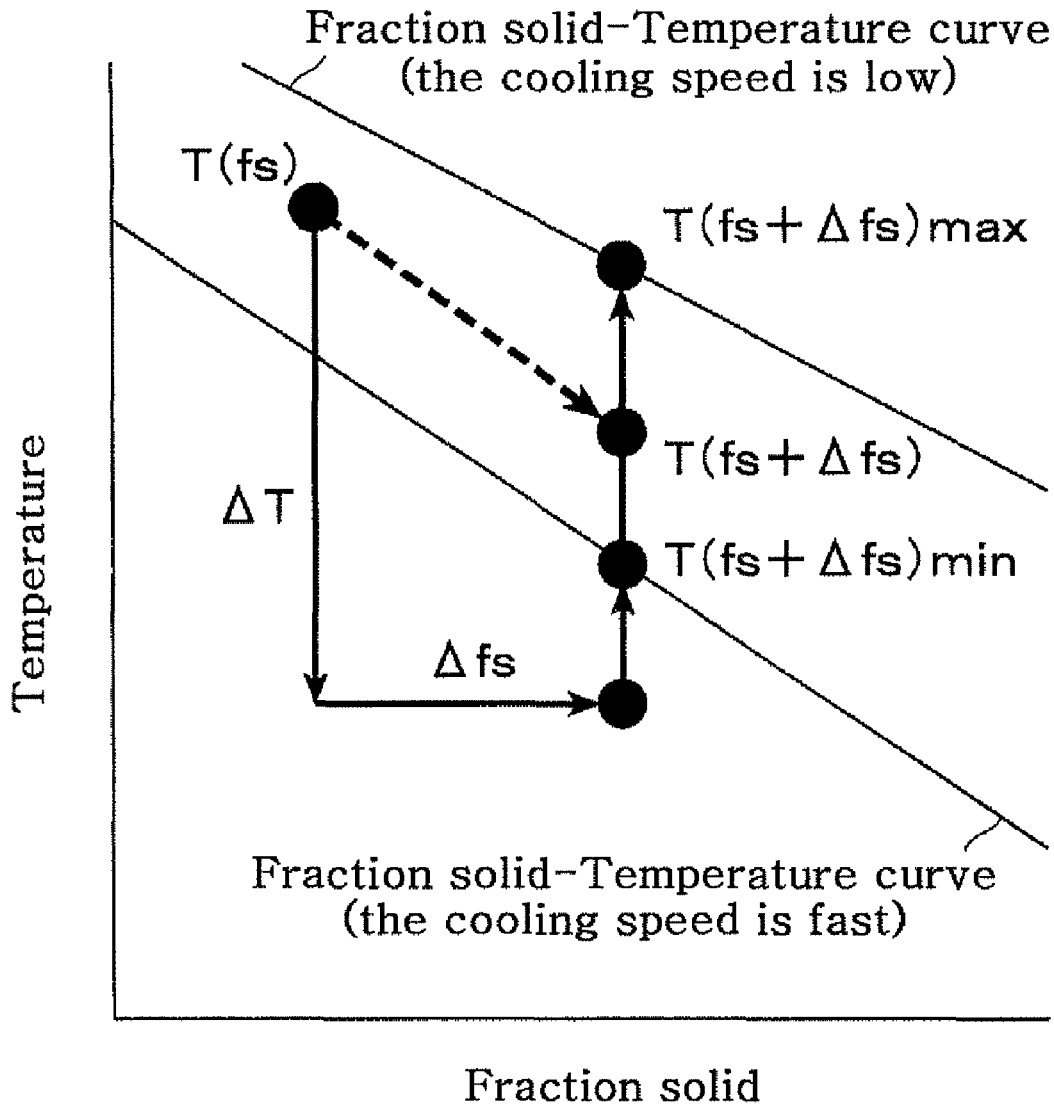
FIG. 5 is a schematic view of two fraction solid-temperature curves with different cooling speeds.
Figure 6:
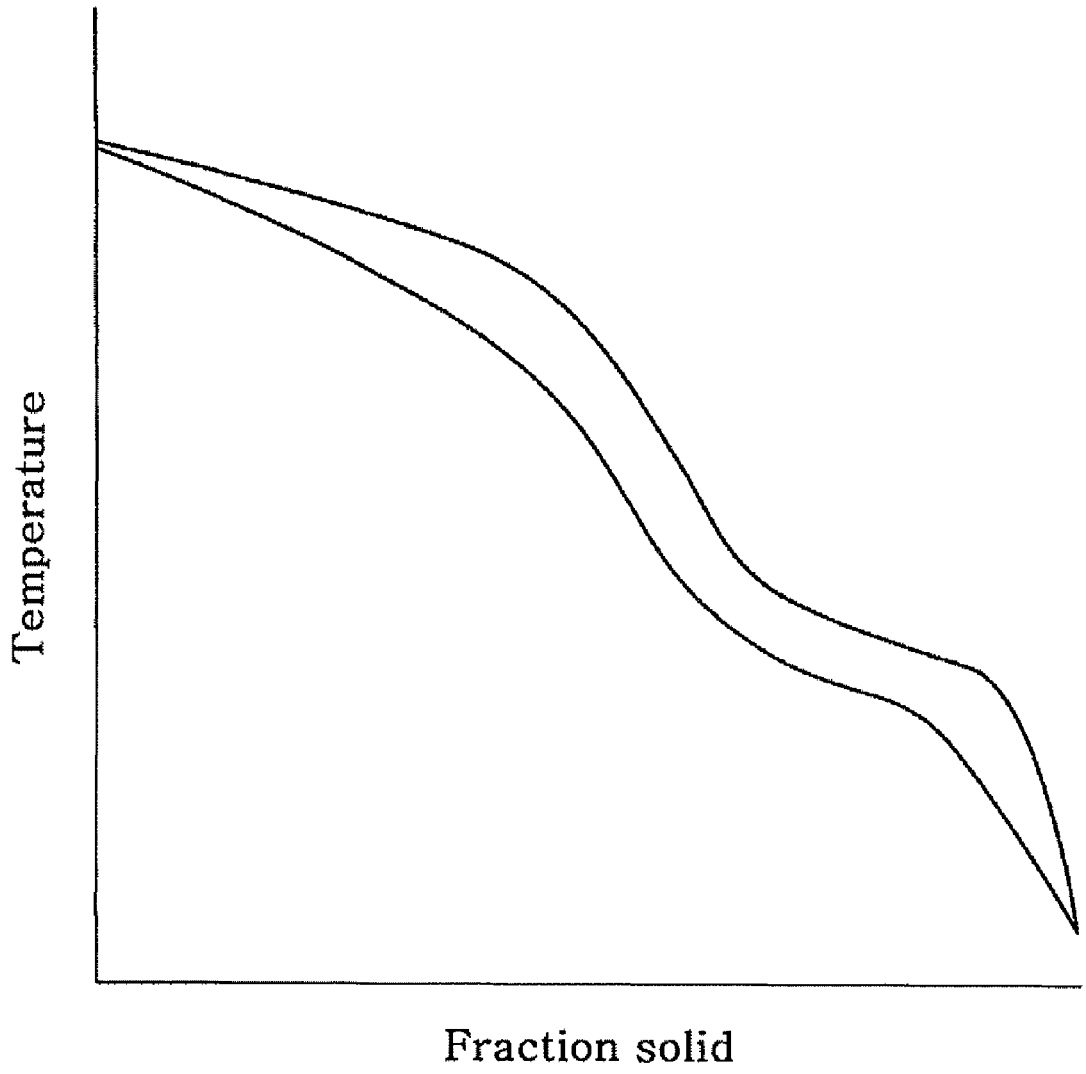
FIG. 6 is a schematic model view of two fraction solid-temperature curves with different cooling speeds.

FIG. 5 schematically shows two fraction solid-temperature curves having different cooling speeds. FIG. 6 is a schematic model view of two fraction solid-temperature curves having different cooling speeds.

Referring to FIGS. 5 and 6, in the fraction solid-temperature curves, a temperature after the recovery is calculated by using the cooling speed v as a parameter when the temperature fluctuates. As the cooling speed v increases, the temperature fluctuation range becomes narrower.

As shown in FIG. 5, the fraction solid-temperature curves have different cooling speeds. A range of T(s) is established from the cooling speed of the element between a temperature T(fs)max obtained by the fraction solid-temperature curve having a slower cooling speed and a temperature T(fs)min obtained by the fraction solid-temperature curve having a faster cooling speed by using a fraction solid fs per desired time t of the fraction solid-temperature curve. Within the range of T(fs), the target temperature T(fs+Δfs) is calculated by the formula:

$$T(fs+\Delta fs) = T(fs+\Delta fs)\max - \frac{(v-v1)\times(T(fs+\Delta fs)\max-(fs+\Delta fs)\min)}{v2-v1}; \quad (2)$$

Further, the fraction solid-temperature curve shown in FIG. 4 shows that a fraction solid-temperature curve is previously obtained by an experiment depending on an alloy type. T(fs) is established such that the fraction solid-temperature curve in an actual manufacturing process exists between each fraction solid-temperature curve.

Formula 2 is first-order linear interpolated. In Formula 2, when the cooling speed is v1, the temperature is T(fs+Δfs)max. When the cooling speed is v2, the temperature is T(fs+Δfs)min. Using Formula 2 the analysis is performed with finer precision, resulting in precise determinations of the temperature drop history and the fraction solid change.

In this embodiment, two fraction solid-temperature curves having different cooling speeds is explained, although embodiments are not limited thereto. Optionally, the target temperature T(fs+Δfs) may be calculated by interpolation approximating a high-order linear polynomial by using a plurality of fraction solid-temperature curves. Alternatively, the temperature may be calculated by interpolation approximating a second-order linear polynomial by using three fraction solid-temperature curves. The target temperature T(fs+Δfs) can be indicated as T(fs+Δfs)=f(T(fs+Δfs)max, T(fs+Δfs)min, v), which incorporates a function of T(fs+Δfs)max, T(fs+Δfs)min and v. When calculating the target T(fs+Δfs), any calculation method using a relationship of T (s+Δfs)=f(T (fs+Δfs)max, T(fs+Δfs)min, v) may be employed. Further, such interpolation operation may use another polynomial, spline interpolation, etc.

Figure 7:
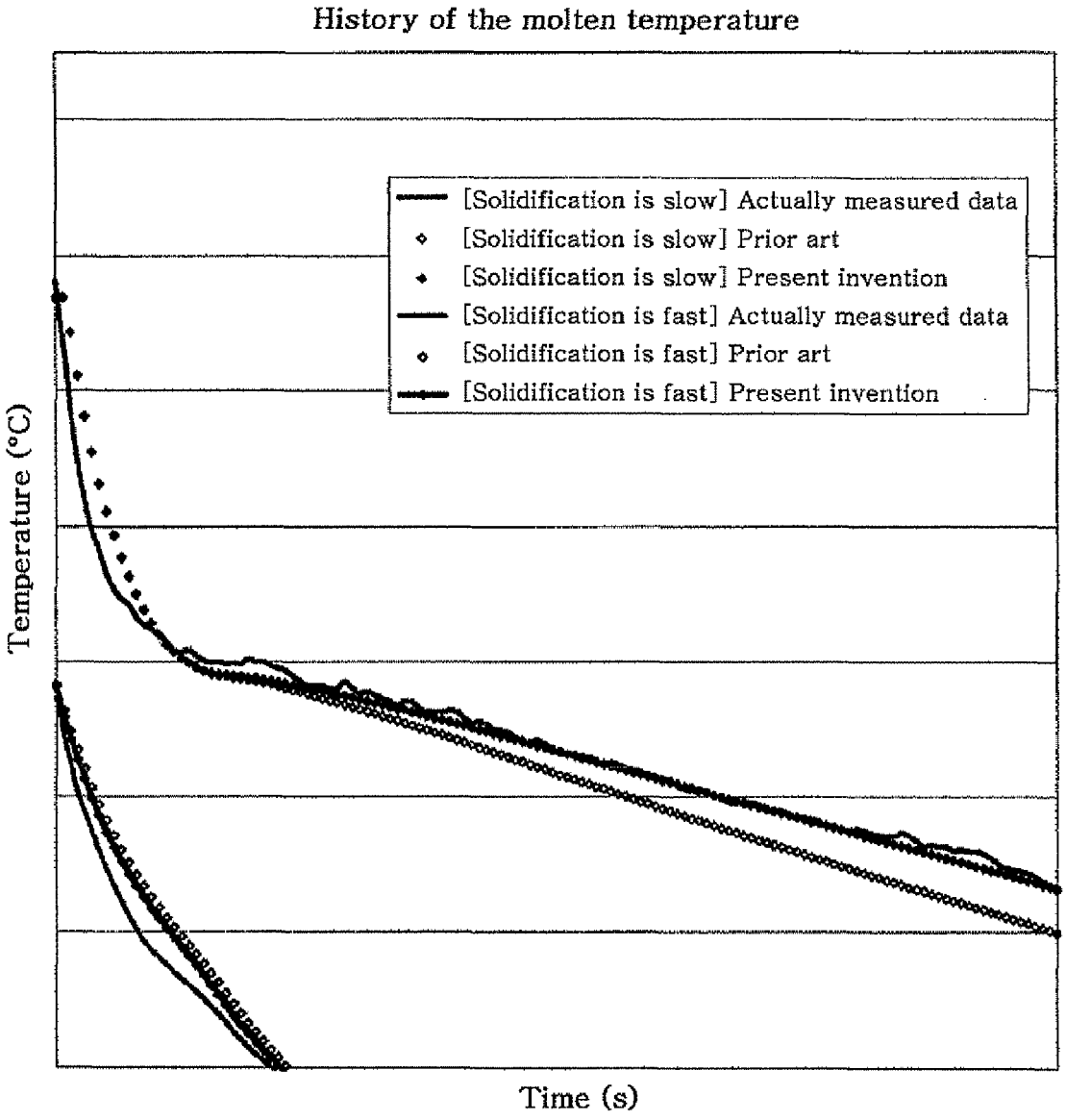
FIG. 7 shows a molten temperature history.

The history of the molten temperature can be obtained by continuously performing the calculation of the temperature fluctuation range with time as discussed above. FIG. 7 shows a history of the molten temperature of a conventional solidification analysis method, a new solidification analysis method disclosed herein, and actually measured data with respect to each case when the solidification is slow (the cooling speed is slow) and when the solidification is fast (the cooling speed is fast). As shown in FIG. 7, according to the new solidification analysis method disclosed herein, the resulting data is much closer to the actually measured data than that of the conventional solidification analysis method.

The above-described embodiments have been described in order to allow easy understanding of the invention and do not limit the invention. On the contrary, the invention is intended to cover various modifications and equivalent arrangements included within the scope of the appended claims, which scope is to be accorded the broadest interpretation so as to encompass all such modifications and equivalent structure as is permitted under the law.

What is claimed is:

1. A solidification analysis method of a cast by using an analysis model having a plurality of elements, the method comprising:

performing a calculation of heat transfer between elements adjacent to each other;

calculating a cooling speed in each element using the calculation of heat transfer between the respective element and its adjacent elements;

revising a temperature fluctuation range in each element when a temperature is fluctuated by an emission of solidification latent heat based on the cooling speed calculated for the respective element and a predetermined fraction solid-temperature curve of a molten alloy; and performing a solidification analysis of the analysis model by using temperature fluctuation range as revised.

2. The method according to claim 1 wherein the fraction solid-temperature curve of the molten alloy includes a fraction solid-temperature curve depending on the cooling speed calculated for the respective element.

3. The method according to claim 2 wherein the fraction solid-temperature curve of the molten alloy includes a fraction solid-temperature curve having a different cooling speed; and wherein performing the solidification analysis comprises:

establishing a range of temperatures depending on the cooling speed of the respective element between a temperature T(fs)max obtained by one fraction solid-temperature curve and a temperature T(fs)min obtained by another fraction solid-temperature curve having a cooling speed faster than the one fraction solid-temperature curve by using a fraction solid fs at a desired time t; and calculating a target temperature T(fs+Δfs) in the range depending on a relationship:

$$T(fs+\Delta fs)=f(T(fs+\Delta fs)\max,T(fs+\Delta fs)\min,v);$$

wherein fs is the fraction solid;

Δfs is the change in the fraction solid; and v is a cooling speed associated with T(fs+Δfs).

4. The method according to claim 3 wherein the relationship T(fs+Δfs)=f(T(fs+Δfs)max, T(fs+Δfs)min, v) is equal to the relationship:

$$T(fs+\Delta fs)=T(fs+\Delta fs)\max-\frac{(v-v1)\times(T(fs+\Delta fs)\max-(fs+\Delta fs)\min)}{v2-v1};$$

wherein v1 is a cooling speed associated with T(fs+Δfs)max; and v2 is a cooling speed associated with T(fs+Δfs)min.

5. The method according to claim 2 wherein performing the solidification analysis further comprises:

performing the solidification analysis having different latent heat emitting patterns depending on the cooling speed.

6. A solidification analysis method of a cast using a mold having a plurality of elements, the method comprising:

A) measuring a heat transfer from each element of the mold based on latent heat emission, B) predicting a designated temperature for each element based on the heat transfer measured;

C) calculating a cooling speed based on a change from a start temperature to the designated temperature over a predetermined time interval;

D) providing a fraction solid-temperature curve based on the cooling speed and a molten alloy of the mold;

E) calculating a change in a fraction solid;

F) calculating a corrected designated temperature based on the fraction solid-temperature curve and the change in the fraction solid; and G) repeating A) through F) with the corrected designated temperature as the start temperature.

7. The method according to claim 6 wherein G) produces a second fraction solid-temperature curve of the molten alloy based on a different cooling speed, the method further comprising:

establishing a temperature range for the corrected designated temperature between a temperature T(fs+Δfs)max on the fraction solid-temperature curve for a slower cooling speed and a temperature T(fs+Δfs)min on the fraction solid-temperature curve for a faster cooling speed, at a fraction solid fs at a desired time t in the fraction solid-temperature curve; and calculating the corrected designated temperature within the temperature range depending on the formula:

$$T(fs+\Delta fs)=f(T(fs+\Delta fs)\max,T(fs+\Delta fs)\min,v);$$

wherein

T(fs+Δfs) is the corrected designated temperature;

fs is the fraction solid;

Δfs is the change in the fraction solid; and v is a cooling speed associated with T(fs+Δfs).

8. The method according to claim 7 wherein the corrected designated temperature is calculated based on the formula:

$$T(fs+\Delta fs)=T(fs+\Delta fs)\max-\frac{(v-v1)\times(T(fs+\Delta fs)\max-(fs+\Delta fs)\min)}{v2-v1};$$

wherein v1 is a cooling speed associated with T(fs+Δfs)max; and v2 is a cooling speed associated with T(fs+Δfs)min.

9. The method according to claim 6, further comprising:

performing A) through G) for alloys having different latent heat emitting patterns depending on the cooling speed.

10. A solidification analysis apparatus for a cast using a mold having a plurality of elements, wherein the apparatus is a computer comprising:

means for calculating a cooling speed in each element from a latent heat emitted from each element;

means for revising a temperature fluctuation range in each element due to the emission of latent heat based on the calculated cooling speed and a predetermined fraction solid-temperature curve of a molten alloy; and means for performing a solidification analysis of the analysis model by using the revised temperature fluctuation range.

* * * * *